United States Patent [19]

Berginski

[11] 4,281,226

[45] Jul. 28, 1981

[54] IGNITION SWITCH

[75] Inventor: Werner Berginski, Werdohl-Eveking, Fed. Rep. of Germany

[73] Assignee: Firma Leopold Kostal, Luedenscheid, Fed. Rep. of Germany

[21] Appl. No.: 90,990

[22] Filed: Nov. 5, 1979

[30] Foreign Application Priority Data

Nov. 17, 1978 [DE] Fed. Rep. of Germany ..... 2849914

[51] Int. Cl.[3] ..... H01H 27/00; H01H 1/20

[52] U.S. Cl. ..... 200/44; 200/243; 200/153 LB

[58] Field of Search ..... 200/243, 44, 64, 63 R, 200/77, 155 R, 153 LB

[56] References Cited

U.S. PATENT DOCUMENTS

| | | | |
|---|---|---|---|
| 3,172,968 | 3/1965 | Arendt | 200/44 |
| 3,522,394 | 7/1970 | Bellrose | 200/44 |
| 3,676,617 | 7/1972 | Miller | 200/44 |
| 3,683,133 | 8/1972 | Heap | 200/44 |
| 3,793,500 | 2/1974 | Gerber | 200/44 |

*Primary Examiner*—Willis Little

*Attorney, Agent, or Firm*—Bacon & Thomas

[57] ABSTRACT

A rotary ignition switch has a pair of tiltable bridges extending in opposed directions and spring-pressed toward a center contact. When the switch is rotated a first end of one bridge remains against the center contact while its other or contact end rides up a helical cam track. The first end of the other bridge rests on the one bridge while its other or contact end also rides up a helical track. The contact ends of both bridges then drop off the helical cam tracks onto fixed contacts to complete respective circuits.

8 Claims, 8 Drawing Figures

Fig. 5
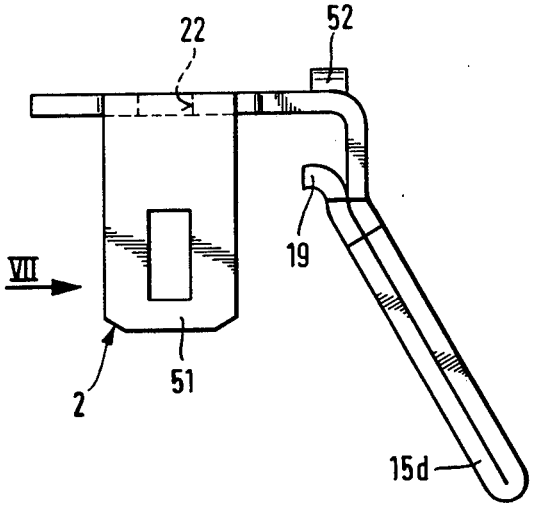
Fig. 7
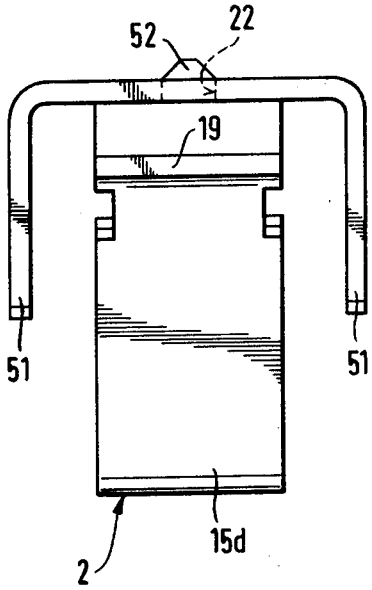
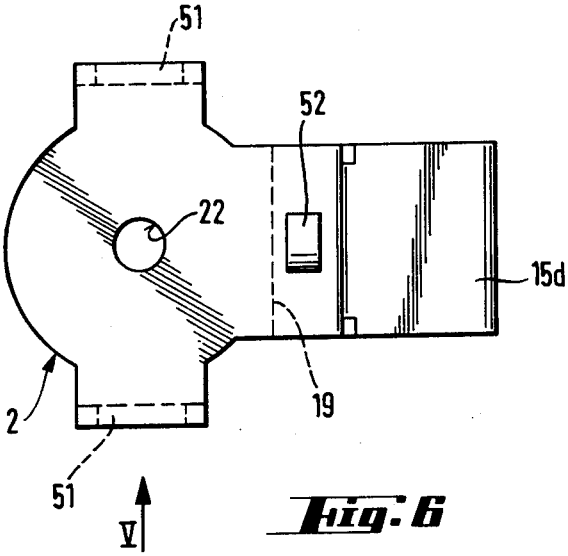
Fig. 6

IGNITION SWITCH

BACKGROUND OF THE INVENTION

Numerous forms of embodiment of ignition switches are known. In an ignition switch according to German application No. 28 27 400.2-34 the central contact is designed in the form of a segment of a ball socket, wherein a contact spring or several contact springs, also equipped ball socket segments, are engaged stacked above each other, under prestressing. The contacting by these contact springs of the contact plates arranged in the switch socket is controlled by means of helically rising profiled tracks.

This arrangement affords certain substantial advantages over the state of the art in regard to savings in expensive contact materials, easier assembly and mechanical and electrical safety of contact. On the other hand, the large scale production of the contact springs with their complex design and inherent spring action and the resultant sensitivity to deformation during transport within the manufacturing plant, requires considerable investment. Furthermore, in the case of inherent spring action and also inherent spring action supported by, for example, supplemental pressure springs, a functionally detrimental decline in contact pressure must be expected upon the occurrence of a current overload and the associated overheating of the contact springs.

SUMMARY OF THE INVENTION

The invention concerns an ignition switch with a starter repeat lock and a warning signal contact, with a socket having a central midposition contact and a plurality of edge contacts and with the control knob thereof, aligned with the spindle center point, entraining two contact bridges ending in switching profiles and establishing contact with edge contacts, said contact bridges being resiliently prestressed against the socket part.

It is the object of the invention to further facilitate installation by means of a simple design of the switching elements combined with a reduction in the number of individual parts and to improve mechanical and electrical functions even more.

The object is attained according to the invention wherein the first of the contact bridges, designed in a planar and congruent manner, is in permanent direct contact and the second contact bridge in permanent indirect contact by means of said first contact bridge with the mid-position contact. Both contact bridges are stressed by a single pressure spring centrally located in the control knob, said pressure spring effecting in combination with a helical spiral section protruding from the wall of the socket and a similar section located on the wall of the housing and facing said first spiral section at an angle of 180°, and with the edge contacts, the contact pressure, the prestressing for impact contacting and contact separation, and notch engaging.

The design of the contact bridges in the form of planar, rigid stamped parts which are also congruent, considerably simplifies their production from a tooling standpoint and renders them insensitive to damage during transportation and assembly. In the case of current overloads, the contact bridges are much more robust in comparison with the contact springs. It should be recognized as particularly important that a single pressure spring performs several functions, i.e., it produces the contact pressure, provides the prestressing for impact-like contacting and effects contact separation and the engaging in notches. The guidance of the two contact bridges by means of a helical spiral section each affords their gradual lifting. This prevents canting capable of causing uncertain contacting, as is often encountered in the case of switches with steep switching profiles. Of particular advantage is the connection of the two contact bridges with the mid-position contact maintained through all of the switching processes, whereby burn-up between the three current transfer elements is prevented.

By means of a center bore in the mid-position contact through which a cam follower carried in the controlled by the cam of the lock cylinder, acts on a contact spring, which in turn contacts a tongue located in a second plane in the midposition contact, a contact location is created in a simple manner, serving to switch a warning or surveillance circuit.

The layout of the contact bridges by means of the annular design of the center part, makes possible the passage of the cam follower to the warning signal switch located underneath the mid-position contact. The small foot like protrusions cast onto one side provide definite contacting by the contact bridges of each other and between said contact bridges and the mid-position contact, while the switching arms slide upwards on the helical spiral.

By means of the fact that the first contact bridge, in direct contact with the mid-position contact, switches the ignition current, the shortest possible current path at the most highly loaded circuit is provided, thus attaining the slightest possible drop in voltage.

The provision that the switch notch positions are effected by the suitable design of the ends of the switching arms of the contact bridges and of the edge contacts results in the elimination of separate notch engaging elements.

By means of a difference in height between the ends of the helical spiral sections and the edge contacts a switching process with a kinetic energy large enough to strike through contact oxidations such as those developing during extensive periods of nonactivation of the switch, is generated.

The starter repeat lock which is activated impact-like upon the return sliding of the contact arm of the contact bridge on the ignition edge contact, whereby the contact arm jumps to a lower level of an insulating section of the wall, renders it impossible to override the starter repeat lock, as does occur in switches according to the present state of the art, because the starter repeat lock and the electric contact system form a single unit, while in the known switches the electric contact system and the mechanical lock system represent two separate structural groups that are difficult to coordinate with respect to tolerances.

Upon the further reverse rotation of the ignition key the contact arm of the contact bridge transferring the ignition current to the corresponding edge contact is again brought on a lower, noncontact level and also impacts upon a wall of insulating material of the socket, if a repeat attempt is made. This doubles the mechanical load carrying ability of the starter repeat lock.

BRIEF DESCRIPTION OF THE DRAWINGS

The invention will be explained in more detail hereinbelow with the aid of drawings, wherein:

FIG. 5 is a side view of the middle contact;

FIG. 6 is a top view of said contact;

FIG. 7 is a front view of the same; and

DESCRIPTION OF THE PREFERRED EMBODIMENT

Figure 1:
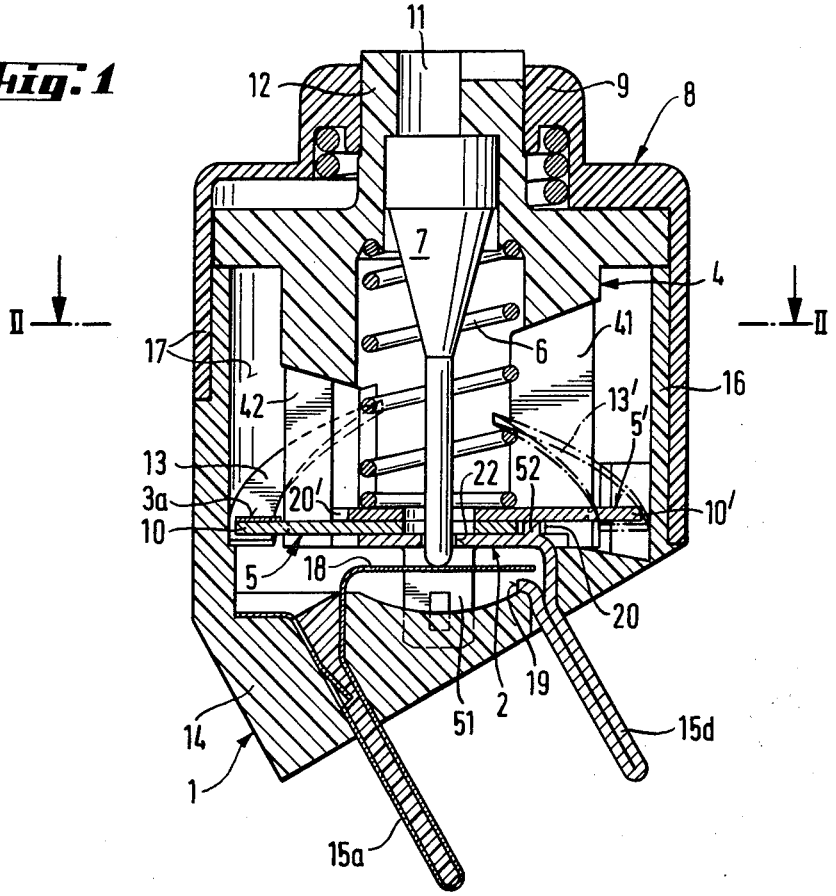
FIG. 1 is an axial section through an ignition switch embodying the present invention, in the "off" position.

The socket 1 has a mid-position contact 2 fastened therein, the contact bridges 5, 5' carried in the switching wheel 4 are stressed downwardly by a pressure spring 6 centrally located in the switching wheel 4, a pin 7 is carried within the pressure spring 6 in the switching wheel 4. A hood 8 with its dome 9 wherein a coil spring, not described in detail because such are already known, is located, said spring effecting the return of the switching sheel 4 from the starter position into the ignition position, may be seen in FIG. 1. Each of the contact bridges 5, 5' carries a switching arm 10, 10' which are diametrically opposed to each other and in the switch-off position the contact bridge 5 lies flat on the mid-position contact 2 and the contact bridge 5' in turn lies flat on the contact bridge 5. The contact 2 comprises two projecting arms 51. The rectangular bent ends of the same are inserted into receiving holes of the socket 1 and also a projection 52 is provided on the surface of the contact. The switching wheel 4 extends with a cylindrical extension 12 through the dome 9 of the hood 8, a switching profile 11 is provided within said extension 12. Also the helical section 13, 13' on the inner wall 16 of the socket in the wall 17 of the hood 8, respectively, together with the contact spring 18 which under the action of the pin 7 establishes contact through the center bore 22, with the tongue 19 of the mid-position contact 2, may be recognized.

Figure 2:
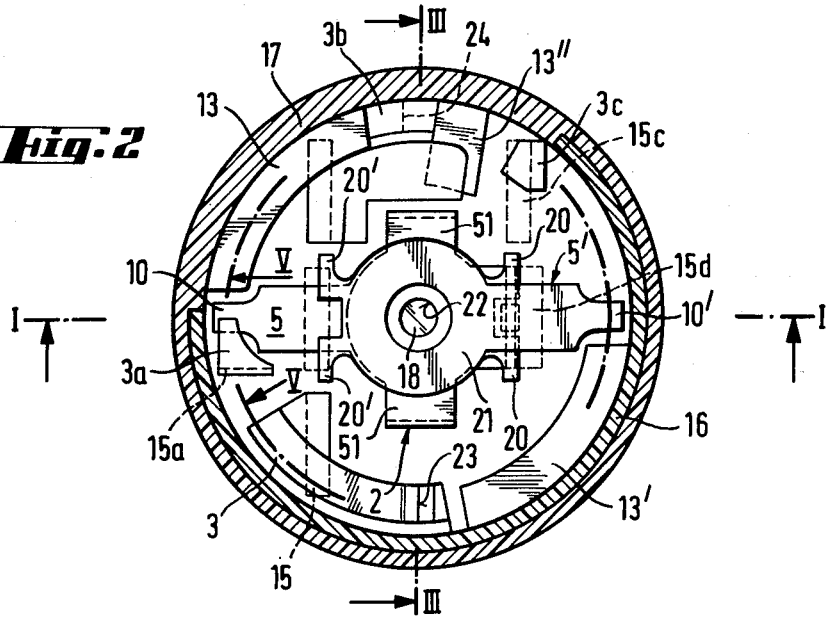
FIG. 2 is a top view of the socket part.

The arrangement of the edge contacts 3, **3*a*, 3*b*, 3*c* and of the mid-position contact 2 with their connecting plugs 15, 15*a*, 15*b*, 15*c* and 15*d* extending downward through the bottom of the socket 14, the two contact bridges 5, 5' with their switching arms 10, 10' and the helical sections 13, 13' in the socket wall 16 and the hood wall 17, respectively, are shown particularly clearly in FIG. 2**.

Figure 3:
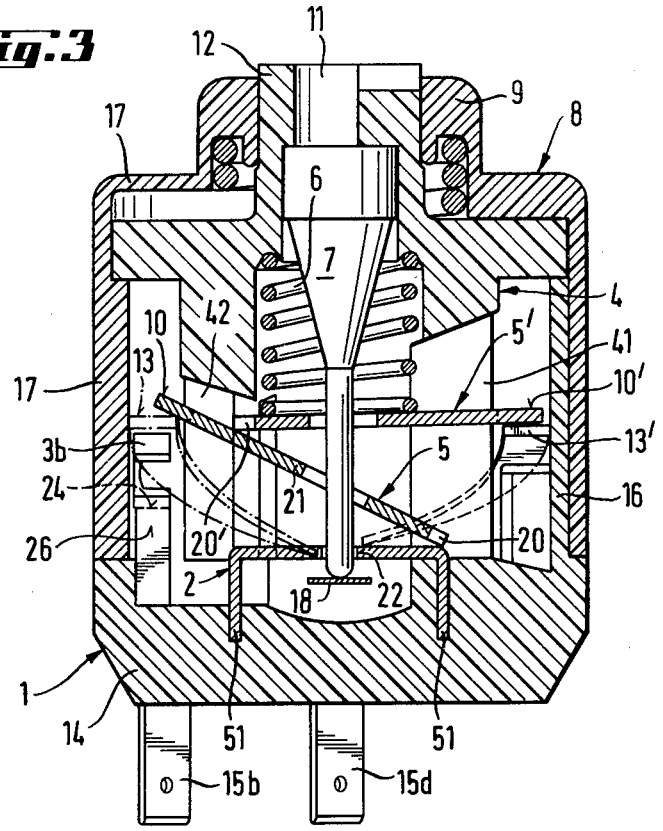
FIG. 3 is an axial section through the switch in the maximum lift position of the contact bridges taken along line III—III of FIG. 2.

As shown in FIG. 3, the switching arms 10 and 10' of the contact bridges 5 and 5' run up on the helical sections 13 and 13', respectively, shortly before the impacting of the switching arm 10 on the edge contact **3*b* and the switching arm 10' on the edge contact 3. Under the effect of the pressure spring 6, the contact bridge 5 rests with its small feet 20 against the mid-position contact 2, and the contact bridge 5' with its small feet 20' against the contact bridge 5. The projection 52 locks the contact bridge 5** in the switch-off position.

Figure 4:
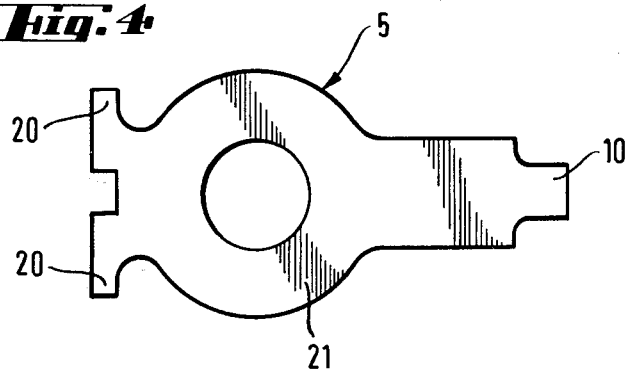
FIG. 4 is a top view of a contact bridge.

FIG. 4 shows the contact bridge 5 with its annular center part 21, the small feet 20 and the switching arm 10. The switching arm 10 of the contact bridge 5 is guided by a slot 42 of the switching wheel 4, and the switching 10' of the contact bridge 5' is guided by a slot 41.

Figure 8:
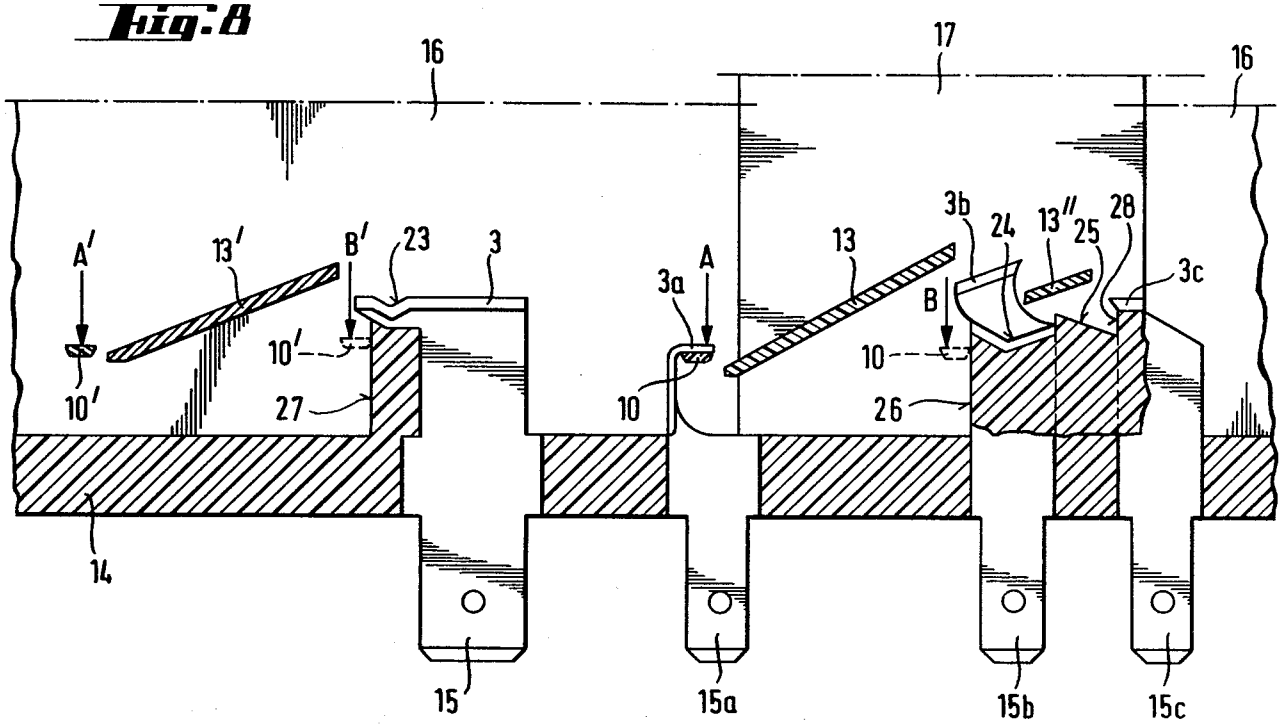
FIG. 8 is a development of the socket wall as viewed from the switching axis.

FIG. 8 shows the development of the socket wall 16 and the hood wall 17, respectively, together with the helical sections 13, 13', 13'', forming a single piece with said walls, and the edge contacts 3, **3*a*, 3*b* and 3*c* with the connecting plugs 15, 15*a*, 15*b*, 15*c* and 15*d* mounted in the socket bottom 14, and the switching arm of the contact bridge 5 and 10' of the contact bridge 5'**.

When by means of the ignition key inserted into cylinder lock, the switching wheel 4 is rotated in the clockwise direction as seen in FIG. 2, the projection 52 releases the feet 20 and the switching arms 10 and 10' travel from their rest position A (contact with the parking light contact **3*a*) and A' (no contact), respectively, onto the helical sections 13 and 13', respectively, wherein the small feet 20 and 204 , respectively, of the contact bridges 5 and 5' rest against the mid-position contact 2 and against the contact bridge 5, respectively, so that a permanent connection of the two contact bridges with the mid-position contact 2** is maintained during the entire switching movement.

Upon the further rotation of the key, the switching arms 10 and 10' travel to and over the highest peak of the helical spiral sections 13 and 13', respectively, and impact from this position under the action of the pressure spring 6, the edge contacts 3 (ignition contact) and **3*b*** (headlight contact).

If the key is moved still further in the clockwise direction, the switching arm 10 of the contact bridge 5 initially strikes the short spiral section 13'' and from there impacts the edge contact **3*c* (starter contact). The switching arm 10' in the meantime slides without interruption along the edge contact 3** (ignition contact).

Upon the release of the key, the switching arm 10 jumps under the effect of the return spring in the counterclockwise direction from the edge contact **3*c* first onto a lower noncontact level, where repeat starting is already impossible, because the switching arm 10 is blocked by the vertical insulating wall 28. The switching arm 10 then slides upward on an inclined insulating wall 25 in order to strike from there a pawl profile 24 embossed in a second plane of the edge contact 3*b*, thus effecting the "drive" position. In the meantime the switching arm 10' of the contact bridge 5' has slid back in the counterclockwise direction onto the edge contact 3 in the pawl profile 23**.

If an attempt is made to start the engine from this pawl position, either because the engine did not start during the initial starting process, or because the noise of the running engine has not been heard, no restarting is possible from this position, because the switching arm 10 strikes the vertical wall of the inclined insulating wall 25, thus activating the locking process.

If the ignition key is rotated only slightly from its pawl position in the counterclockwise direction, the switching arms 10 and 10' are released from the paul profiles 24 and 23, respectively, of the edge contacts **3*b* and 3, and come to rest on a lower noncontact level. If then an attempt is made to start the engine, double locking takes place (position B, B'), whereby the switching arm 10 abuts against the insulating wall 26 and the switching arm 10' against the insulating wall 27**. Repeated starting is thus possible from the A, A' position only.

I claim:

1. An ignition switch comprising a part defining a generally cylindrical socket provided with a hood covering the socket and enclosing the components of the switch, a central contact and edge contacts in said socket, a rotatable switching wheel in said socket, two contact bridges having switching arms at their ends for engagement with said edge contacts and arranged to be driven in rotation by said switching wheel, said contact bridges being substantially planar with one in direct and permanent contact with said central contact and the other in direct and permanent contact with said one bridge, a single pressure spring in said switching wheel acting to urge the switching arms of both said bridges toward said edge contacts, diametrically opposed helical sections projecting radially inwardly of said socket into the path of rotation of said switching arms whereby rotation of said switching wheel causes said planar bridges to tilt and said switching arms to ride up said helical sections and drop from upper ends thereof and impact on certain of said edge contacts under the influence of said pressure spring.

2. Ignition switch according to claim 1, wherein the contact bridges (5, 5') have an annular center part (21), with small feet (20) integrally formed on one side thereof, whereby the first contact bridge (5) during the switching process rests against the said central contact (2), and the second contact bridge (5') against the first contact bridge, switching arms (10) and (10') being extendingly attached thereto, said contact arms effecting contact with the edge contacts (3, 3*a*, 3*b*, 3*c*).

3. Ignition switch according to claim 1, wherein the first contact bridge (5), establishing contact with the said central contact, activates the starter current.

4. Ignition switch according to claim 1, wherein switching notch positions are established by profile configuration of the ends of the switching arms (10, 10') of the contact bridges (5, 5') in combination with the profiles (23, 24) of the edge contacts 3, 3*b*).

5. Ignition switch according to claim 1, wherein an impact-like switching process is obtained by means of a suitable difference in height between the ends of the helical spiral sections (13, 13', 13'') and the edge contacts (3, 3*b*, 3*c*).

6. Ignition switch according to claim 1, wherein upon return sliding of the two ends of the switching arms (10, 10') diametrically opposed to each other, of the contact bridges (5, 5') onto the starter edge contact (3*c*) and the ignition edge contact (3), respectively, from the starter position under the action of a return spring, initially the switching arm (10) activating the starter current impacts a lower, noncontacting level in the switching socket (1), under the action of the pressure spring (6) upon leaving the starter edge contact (3*c*) and is locked by a wall of an insulating material (28) of the socket, if an attempt is made to rotate the ignition key into the starter position.

7. Ignition switch according to claim 1, wherein during further reverse rotation of the ignition key, in addition to the switching arm (10) which jumps from an arresting notch (24) of the edge contact (3*b*) to a lower noncontacting level and is pressured lockingly against the insulating wall (26) during an attempt at repeated starting, the switching arm (10') of the contact bridge (5') carrying current to the ignition edge contact (3), is also brought impact-like under the action of the pressure spring (6) to a lower, noncontacting level and is again pressured against a wall of insulating material (27) of the socket upon an attempt at repeated starting.

8. An ignition switch as defined in claim 1 wherein said central contact has a central opening, an axially movable pin in said switching wheel and extending through said opening, a further contact spring in said socket and having a portion engageable by said pin whereby downward axial movement of said pin flexes said further contact into engagement with a portion of said central contact.

* * * * *